US005411008A

United States Patent [19]

Hsu

[11] Patent Number: 5,411,008

[45] Date of Patent: May 2, 1995

[54] INDEXED LIMB BOLT ASSEMBLY FOR A RECURVE BOW

[75] Inventor: Gary Hsu, Canoga Park, Calif.

[73] Assignee: Micro Inventions Technology Inc., West Hills, Calif.

[21] Appl. No.: 175,113

[22] Filed: Dec. 29, 1993

[51] Int. Cl.[6] ..... F41B 5/00

[52] U.S. Cl. ..... 124/23.1; 124/88; 124/86

[58] Field of Search ..... 124/23.1, 88, 86; 411/14, 222, 244, 393, 940, 945; 73/761; 116/212, DIG. 34

[56] References Cited

U.S. PATENT DOCUMENTS

| | | | |
|---|---|---|---|
| 778,107 | 12/1904 | Burks | 411/244 X |
| 1,305,698 | 6/1919 | Day | 411/244 X |
| 2,830,486 | 4/1958 | Dillon . | |
| 3,060,731 | 10/1962 | Adise . | |
| 3,283,567 | 11/1966 | Fietz | 411/14 X |
| 3,602,186 | 8/1971 | Popenoe . | |
| 3,802,410 | 4/1974 | Palma | 124/23.1 |
| 3,823,639 | 7/1974 | Liber . | |
| 3,851,386 | 12/1974 | Ellzey, Jr. | 116/212 X |
| 3,886,840 | 6/1975 | Bossler . | |
| 4,091,790 | 5/1978 | Hoyt, Jr. | 124/88 X |
| 4,993,397 | 2/1991 | Cryar et al. | 124/23.1 |
| 5,090,395 | 2/1992 | Gannon | 124/86 X |
| 5,121,736 | 6/1992 | Hawk | 124/86 |
| 5,165,831 | 11/1992 | Yager et al. . | |
| 5,231,970 | 8/1993 | Ploot et al. | 124/23.1 |

*Primary Examiner*—Eric K. Nicholson
*Assistant Examiner*—Anthony Knight
*Attorney, Agent, or Firm*—Thomas I. Rozsa; Tony D. Chen

[57] ABSTRACT

The present invention is a limb bolt assembly for a recurve bow. The recurve bow has an upper limb, a lower limb, and a center riser with an upper end and a lower end each having a U-shaped slot for receiving a proximal end of a respective one of the upper and lower limbs. The limb bolt assembly includes an elongated threaded bolt mounted across the U-shaped slot, an index plate for indexing a rotational position of the bolt, a sleeve located inside the U-shaped slot and threadedly engageable with the elongated bolt and further engaging with the proximal end of the respective one of the upper and lower limbs, an end attached to the end of the bolt, and a plug mounted at a bottom opening of the U-shaped slot. The sleeve has an enlarged flange with straight rim portions for engagement with the inside sidewalls of the U-shaped slot from rotating inside the U-shaped slot, so that the sleeve can be driven along the bolt by rotating the bolt to adjust the poundage and tiller of the recurve bow. The limb bolt assembly further includes positive locking members for locking the bolt to prevent it from rotating after adjustment.

20 Claims, 2 Drawing Sheets

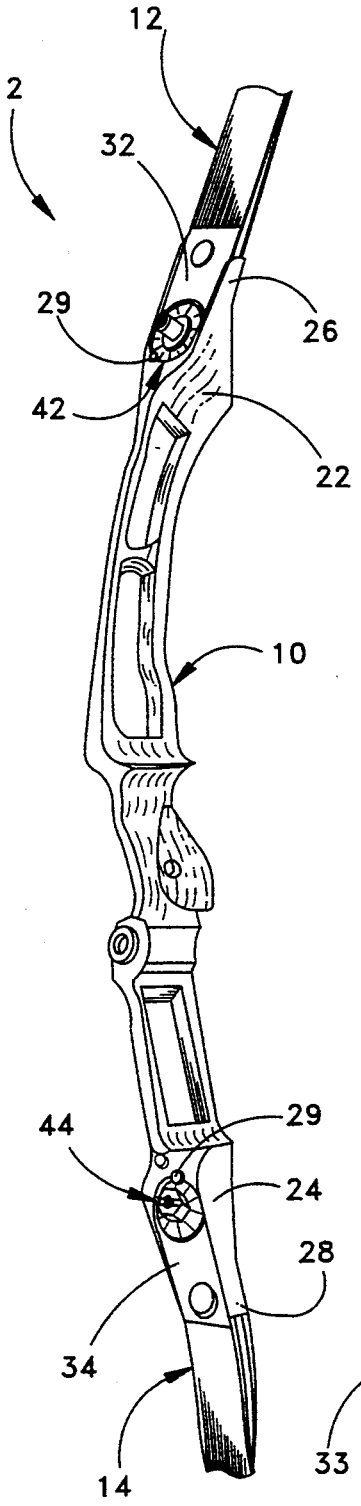
FIG. 1
FIG. 2
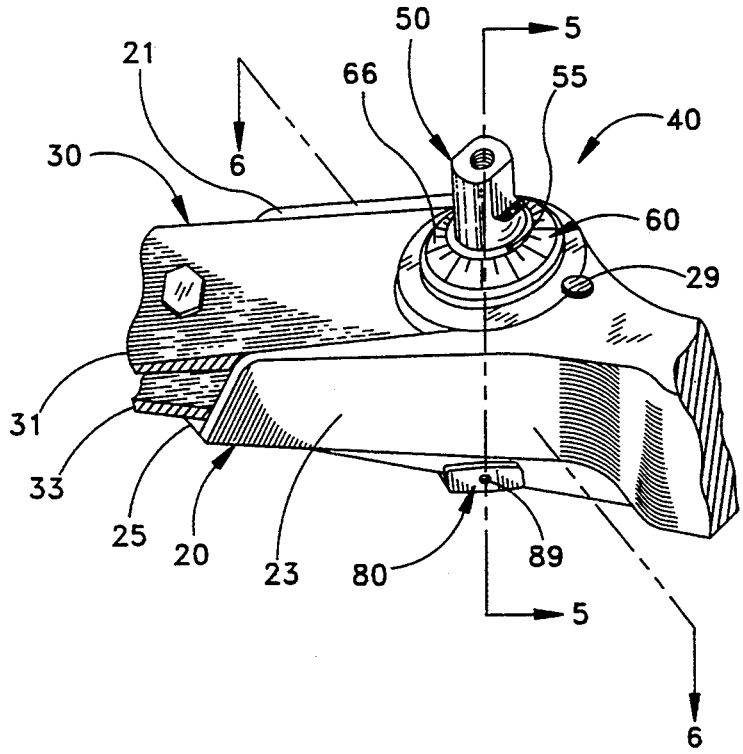
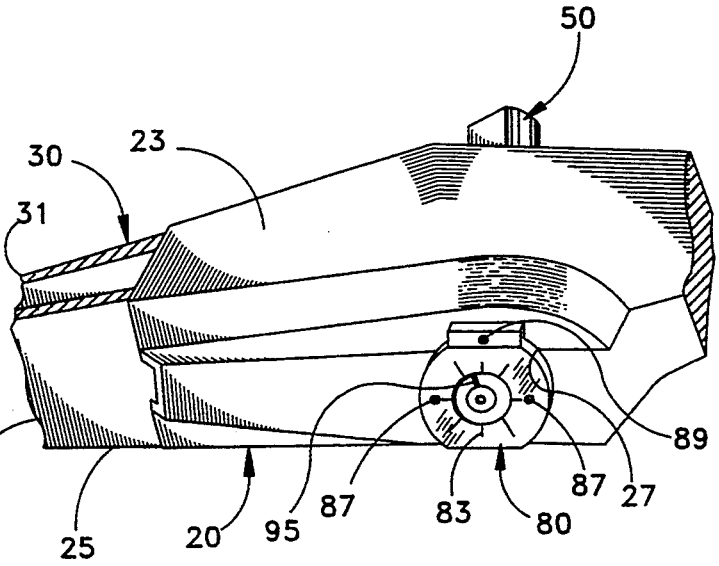
FIG. 3

FIG.4
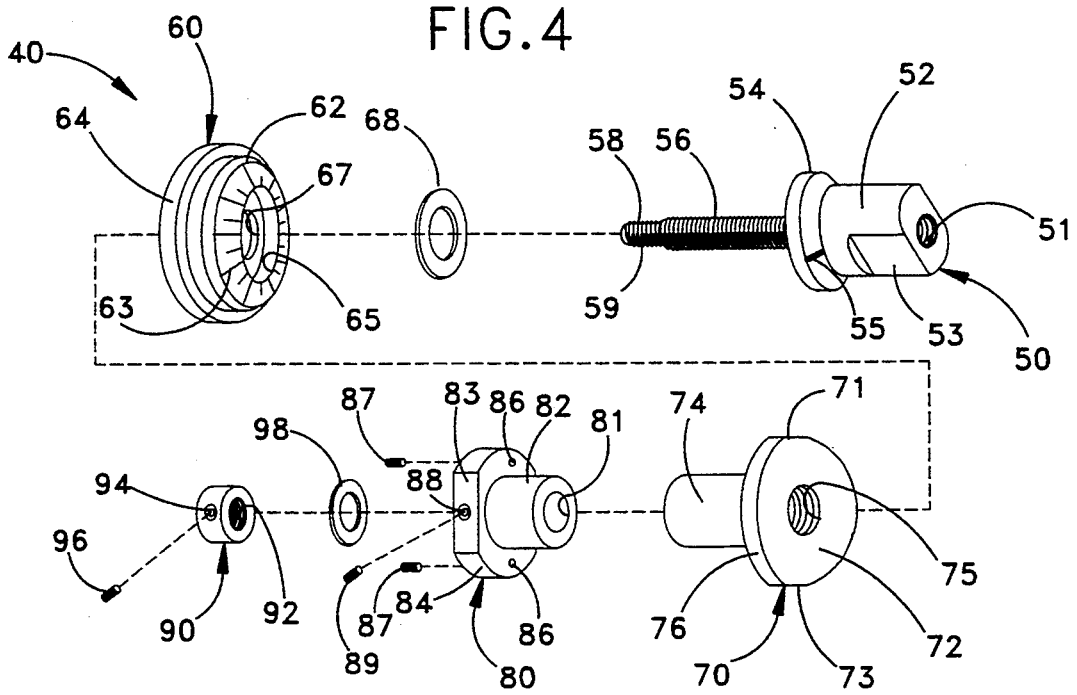
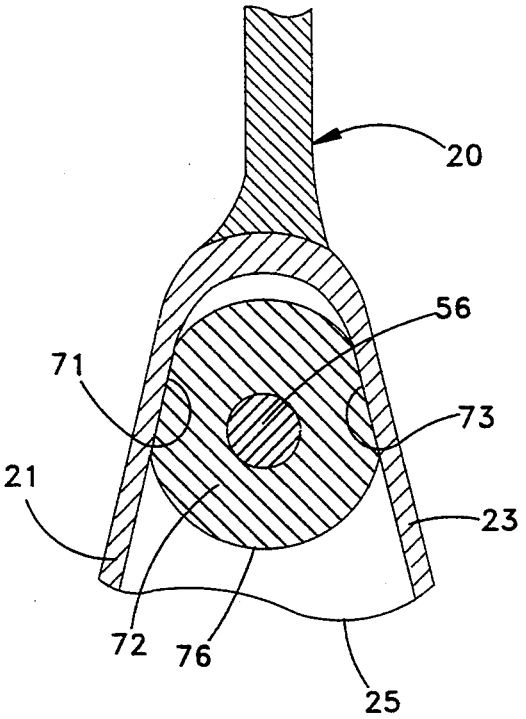
FIG.6
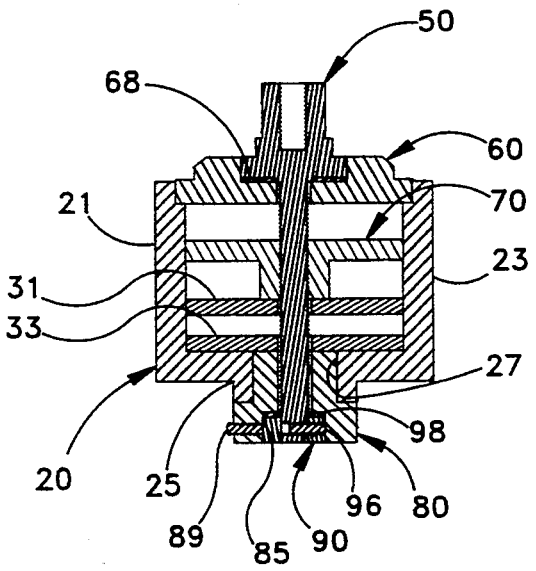
FIG.5

INDEXED LIMB BOLT ASSEMBLY FOR A RECURVE BOW

BACKGROUND OF THE INVENTION

1. Field of The Invention

The present invention generally relates to the field of design and construction of archery bows. More particularly, the present invention relates to the field of an improvement on the limb bolt assembly used on recurve bows.

2. Description of The Prior Art

Most of today's recurve bows are three-piece take-down units. A typical three-piece recurve bow has a center riser section, an upper limb and a lower limb. The upper and lower limbs are respectively mounted to the upper and lower ends of the center riser by limb bolts. The limb bolts essentially serve two main functions. First, they are used for mounting the upper and lower limbs to the center riser. Second, they are used for adjusting the poundage of the bow. Some recurve bows further utilize the same limb bolt for adjusting the tiller of the bow. As used conventionally, "poundage" refers to the overall strength of the limbs measured in pounds when the bow is drawn to a standard distance, e.g., twenty-eight inches (28"), and "tiller" refers to the balance of the relative strengthening or weakening of the upper and lower limbs of the bow.

On prior art recurve bows, the limb bolts are usually simple screw bolts with a hexagonal head or Allen wrench socket. An archer can use a wrench or Allen wrench to thread the limb bolt to fasten the upper or lower limb, or adjust the poundage and/or tiller of the bow. However, this arrangement has several disadvantages. First, since the limb bolts are directly engaged with the upper or lower limb of the recurve bow, the repeated vibration of the limbs during the releasing of the arrow often causes the limb bolts to become loose and the poundage settings thrown off. Second, when threading the limb bolt to adjust the poundage and/or tiller of the bow, an archer has no way of knowing when the poundage or tiller is properly adjusted. Therefore, the archer has to repeat the adjustment by time consuming experiments every time to obtain a proper adjustment.

For example, a sixty-pound recurve bow will typically build up sixty pounds (60 lb.) at about a twenty-eight-inch (28") draw. Therefore, to tune in a sixty-pound recurve bow, an archer needs to adjust the limb bolts of the bow and measure the poundage of the bow on a scale machine at twenty-eight-inch draw, until the poundage is set correctly at sixty pounds. However, when the limb bolts become loose because of the vibration of the limb during shooting and need to be readjusted to restore the correct poundage or balanced tiller, the archer has no way to know the previous rotational position of the limb bolts, and has to repeat the whole tuning procedure again by using the scale machine and/or other measuring devices. This process often becomes very time consuming, and very inconvenient and impractical during archery championships, outdoor sporting events or hunting trips.

The following six (6) prior art patents were found to be pertinent to mounting screws with indication means.

1. U.S. Pat. No. 2,830,486 issued to Dillon on Apr. 15, 1958 for "Resilient Nut With Tension Indicating Means" (hereafter "the Dillon Patent").

2. U.S. Pat. No. 3,060,731 issued to Adise on Oct. 30, 1962 for "Motion Translator" (hereafter "the Adise Patent").
3. U.S. Pat. No. 3,602,186 issued to Popenoe on Aug. 31, 1971 for "Opti-Mechanical Stress-Strain Indicator" (hereafter "the Popenoe Patent").
4. U.S. Pat. No. 3,823,639 issued to Liber on Jul. 16, 1974 for "Tension Indicating Fastener" (hereafter "the Liber Patent").
5. U.S. Pat. No. 3,886,840 issued to Bossler on Jun. 3, 1975 for "Bolt Head Which Measures And Maintains Preload" (hereafter "the Bossler Patent").
6. U.S. Pat. No. 5,165,831 issued to Yager et al. on Nov. 24, 1992 for "Capscrew Head Markings For Torque-Angle Tightening" (hereafter "the Yager Patent").

The Dillon Patent discloses a resilient nut with a tension indicating means. It includes a rectangular block having a vertical bore extending therethrough from top to bottom. An indicator is provided with one or more calibration lines positioned at any suitable point along the edge of the block for measuring the flexure.

The Adise Patent discloses a motion translator. An indicator card is carried by an arm at its free end. The card is provided with a uniformly graduated scale.

The Popenoe Patent discloses an opti-mechanical stress-strain indicator. It includes a bolt which has a large bore, and a pin disposed within the bore. The stress is measured by the color change of the fluid within the large bore.

The Liber Patent discloses a tension indicating fastener. It is utilized to support mine shaft roofs. The tension of the mine bolts is measured by a photoelastic member in the form of photoelastic fringes for reading by reflection polariscope.

The Bossler Patent discloses a bolt head which measures and maintains a preload. An indicator-washer is mounted at the periphery of the upper recess, closing the recess and being relatively non-deflecting with respect to the ring, so that the relative position of the indicator pin and indicator-washer or ring is a function of the preload.

The Yager Patent discloses a capscrew head marking for torque-angle tightening. It includes a fastener which has an externally threaded shank portion, a torque receiving portion integrally connected to one end of the shank portion and an outwardly extending flange located between the shank portion and the torque receiving portion.

It can be seen that none of the prior art mounting screws can be suitably used as the limb bolts on a recurve bow where the connections between the upper and lower limbs and the center riser are subject to severe vibrations during the releasing of the arrow. Therefore, it is desirable to develop a new limb bolt assembly for recurve bows. It is desirable that the new limb bolt assembly can tightly mount the upper or lower limb to the center riser of the recurve bow such that the vibration from the releasing of the arrow will not cause the new limb bolt assembly to become loose. It is further desirable that the new limb bolt assembly provide a quick reference of the correct poundage and tiller adjustment to an archer.

SUMMARY OF THE INVENTION

The present invention is an indexed limb bolt assembly for a recurve bow. The limb bolt assembly is used for securely mounting the upper or lower limb to the center riser of the recurve bow, and for quick and easy adjustment of the poundage and tiller of the recurve bow.

It has been discovered, according to the present invention, that if an indexed limb bolt assembly is utilized for fastening the upper or lower limb to the center riser of a recurve bow, where a separate sleeve is positioned in engagement with the upper or lower limb, then the vibration on the upper and lower limbs caused by releasing of the arrow is only directly transmitted to the sleeve of the limb bolt assembly.

It has also been discovered, according to the present invention, that if the sleeve member of the indexed limb bolt assembly is threadedly engaged with a shaft but is prohibited from rotation by an anti-rotation means, then by rotating the shaft, the sleeve can move up or down along the shaft to tighten or loosen the upper or lower limb for adjustment of the poundage or tiller of the bow, but the vibration transmitted on the sleeve cannot cause the shaft to rotate and become loose, because the sleeve is prohibited from rotation by the anti-rotation means.

It has further been discovered, according to the present invention, that if the indexed limb bolt assembly also utilizes an end nut attached on the shaft where the end nut can be positively locked in position, then the shaft cannot rotate any more and the vibration on the upper and lower limbs caused by releasing of the arrow cannot cause the shaft to become loose.

It has additionally been discovered, according to the present invention, that if the indexed limb bolt assembly further utilizes a scale for indexing the adjustment of the poundage and tiller, then the archer does not have to go through the repeated laborious and time consuming process for readjusting the poundage and tiller, because the archer can simply refer back to the scale for the desired adjustment.

It is therefore an object of the present invention to provide an indexed limb bolt assembly which is utilized for fastening the upper or lower limb to the center riser of a recurve bow, where a separate sleeve is positioned in engagement with the upper or lower limb so that the vibration on the upper and lower limbs caused by releasing of the arrow is only directly transmitted to the sleeve of the limb bolt assembly.

It is also an object of the present invention to provide an indexed limb bolt assembly with a sleeve member which is threadedly engaged with a shaft but is prohibited from rotation by an anti-rotation means, so that by rotating the shaft, the sleeve can move up or down along the shaft to tighten or loosen the upper or lower limb for adjustment of the poundage or tiller of the bow, but the vibration transmitted on the sleeve cannot cause the shaft to rotate and become loose because the sleeve is prohibited from rotation by the anti-rotation means.

It is a further object of the present invention to provide an indexed limb bolt assembly which utilizes an end nut attached on the shaft, where the end nut can be positively locked in position so that the shaft cannot rotate any more and the vibration on the upper and lower limbs caused by releasing of the arrow cannot cause the shaft to become loose.

It is an additional object of the present invention to provide an indexed limb bolt assembly which further utilizes a scale for indexing the adjustment of the poundage and tiller, so that the archer does not have to go through the repeated laborious and time consuming process for readjusting the poundage and tiller, because the archer can simply refer back to the scale for the desired adjustment.

Described generally, the present invention is a limb bolt assembly for a recurve bow. The recurve bow has an upper limb, a lower limb, and a center riser with an upper end and a lower end each having a U-shaped slot for receiving a proximal end of a respective one of the upper and lower limbs, where the U-shaped slot has a bottom opening. The limb bolt assembly includes a bolt, a plate, a sleeve, an end nut and a plug. The bolt has a head section, a circular flange section, and a longitudinally elongated shaft section with outer screw threads; the flange section having an upper surface with an index mark and the shaft section having a bottom end. The plate has a raised section and a base section, the raised section having a top surface with index scales and a recess for seating the flange section of the bolt; the base section bridging over the U-shaped slot and having a center hole connected to the recess of the raised section for allowing the shaft section of the bolt to go through. A small cap screw is used for securing the base section of the plate on top of the U-shaped slot and preventing the plate from rotation. The sleeve has a central through bore with internal screw threads for threading on the shaft section of the bolt, the sleeve further having an enlarged flange section and a cylindrical section, the flange section engaged with the inside of the U-shaped slot for preventing the sleeve from rotation, the cylindrical section engaging with the proximal end of the respective one of the upper and lower limbs. The end nut is threaded on the end of the shaft section of the bolt. The end nut is fastened to the end portion of the shaft section of the bolt by an Allen screw to prevent the end nut from rotating thereon. The plug is mounted at the bottom opening of the U-shaped slot and has a central through bore for receiving the bottom end of the shaft section of the bolt, the plug further having a flange section with a recess connected to the through bore for seating the end nut. The plug is secured to the bottom of the U-shaped slot. The end nut is locked with the plug by a small Allen screw to prevent the bolt from rotation after adjustment. When the proximal end of the respective one of the upper and lower limbs is received in the U-shaped slot and fastened between the sleeve and the bottom of the U-shaped slot, the sleeve can be driven along the shaft section of the bolt by rotating the bolt to adjust the poundage and tiller of the recurve bow, where the desired adjustment can be recorded by the index scales and the bolt can be locked to prevent it from becoming loosened.

One of the important features of the present invention is that while the limb bolt is still used for the combined function of mounting the upper or lower limbs of a recurve bow and adjusting the poundage and/or tiller of the bow, the limb bolt itself is not directly subject to the stress of the limb. Rather, a movable sleeve is used for exerting direct pressure on the limb, where the sleeve is threadedly engaged with the limb bolt but prevented from rotation.

Another one of the important features of the present invention is that an index plate is utilized in conjunction with the limb bolt to indicate the correct adjustment of the poundage and tiller of the recurve bow. With the positive indexing provided by the index plate, an archer can quickly refer back to the index of the correct poundage and tiller and thereby avoid the laborious and time consuming process of readjusting the poundage or tiller.

Still another important feature of the present invention is that after the limb bolt is adjusted to the correct position corresponding to the desired poundage and tiller, the limb bolt can be positively locked in position, thereby eliminating the risk of having the limb bolt loosened by vibrations of the limb transmitted to the limb bolt.

Further novel features and other objects of the present invention will become apparent from the following detailed description, discussion and the appended claims, taken in conjunction with the drawings.

BRIEF DESCRIPTION OF THE DRAWINGS

Referring particularly to the drawings for the purpose of illustration only and not limitation, there is illustrated:

FIG. 1 is a partial perspective view of a recurve bow utilizing the present invention limb bolt assembly.

FIG. 2 is a partial perspective view from the top side showing the proximal end of a limb mounted to a distal end of the center riser of the recurve bow by the present invention limb bolt assembly.

FIG. 3 is a partial perspective view from the bottom side showing the proximal end of a limb mounted to a distal end of the center riser of the recurve bow by the present invention limb bolt assembly.

FIG. 4 is an exploded perspective view of the present invention limb bolt assembly.

FIG. 5 is a cross-sectional view taken along line 5—5 of FIG. 2.

FIG. 6 is a cross-sectional view taken along line 6—6 of FIG. 2.

DESCRIPTION OF THE PREFERRED EMBODIMENT

Although specific embodiments of the present invention will now be described with reference to the drawings, it should be understood that such embodiments are by way of example only and merely illustrative of but a small number of the many possible specific embodiments which can represent applications of the principles of the present invention. Various changes and modifications obvious to one skilled in the art to which the present invention pertains are deemed to be within the spirit, scope and contemplation of the present invention as further defined in the appended claims.

Referring to FIG. 1, there is shown at 2 a recurve bow utilizing the present invention limb bolt assembly. The recurve bow 2 has a center riser 10, an upper limb 12, and a lower limb 14. The center riser 10 has an upper end 22 with a U-shaped slot 26 for receiving a proximal end 32 of the upper limb 12, and a lower end 24 with a U-shaped slot 28 for receiving a proximal end 34 of the lower limb 14. The proximal end 32 of the upper limb 14 is mounted to the upper end 22 of the center riser 10 by a present invention limb bolt assembly 42, and the proximal end 42 of the lower limb 14 is mounted to the lower end 24 of the center riser 10 also by a present invention limb bolt assembly 44.

Since the two limb bolt assemblies 42 and 44 are identical, they will be described together in the following figures and descriptions and denoted by a common numeral 40. Likewise, since the mounting of the upper limb 12 and lower limb 14 are essentially the same, and U-shaped slot 26 at the upper end 22 and the U-shaped slot 28 at the lower end 24 of the center riser 10 are essentially the same. In the following figures and descriptions, the U-shaped slot 26 at the upper end 22 and the U-shaped slot 28 at the lower end 24 of the center riser 10 will be described together and denoted by a common numeral 20, and the proximal end 32 of the upper limb 12 and the proximal end 34 of the lower limb 14 will be described together and denoted by a common numeral 30.

Referring to FIGS. 2 through 4, there is shown that the U-shaped slot 20 is formed by two opposite sidewalls 21 and 23 and a bottom 25 which has an opening 27. The proximal end of limb 30 is received inside the U-shaped slot 20. It is noted that the proximal end of limb 30 is split into two pieces 31 and 33 which are only narrowly spaced apart and will quickly join together. They are also slightly curved.

Referring to FIGS. 2 through 5, the present invention limb bolt assembly 40 includes the following basic components: a bolt 50, a plate 60, a sleeve 70, a plug 80, and a end nut 90. The assembly also includes other auxiliary components which will be described later.

The bolt 50 has a generally cylindrical shaped head section 52, a circular disc shaped flange section 54, and a longitudinally elongated shaft section 56 with outer screw threads. The head section 52 has a top screw hole 51 which may be used for attaching other accessories. The head section 52 also has two opposite flattened surfaces 53 for adopting a driving tool such as a wrench for turning the bolt 50. The flange section 54 has a circular upper surface with a primary index mark 55 which can be a small arrow or simply a line. The shaft section 56 has an end portion 58 with a reduced diameter and a transverse screw hole 59.

The plate 60 has a raised section 62 and a circular disc shaped base section 64. The raised section 62 has a top surface with primary index scales 63 and a circular recess 65 for seating the flange section 54 of the bolt 50, such that the upper surface of the flange section 54 of the bolt 50 can be flush with the top surface of the raised section 62 of the plate 60. The base section 64 has a center hole 67 which is connected with the recess 65 of the raised section 62 for allowing the shaft section 56 of the bolt 50 to go through. A small washer 68 may be placed in the recess 65, underneath the flange section 54 of the bolt 50. The base section 64 of the plate 60 bridges over on top of the two sidewalls 21 and 23 of the U-shaped slot 20 and is secured thereon by a small cap screw 29 to prevent the plate 60 from rotating.

The sleeve 70 has an enlarged flange section 72 and a cylindrical section 74. Particularly referring to FIG. 6, the flange section 72 has a generally circular shaped circumferential rim 76 with two straight portions 71 and 73 respectively engaged with the two sidewalls 21 and 23 of the U-shaped slot 20 for preventing the sleeve from rotating. The sleeve 70 also has a central through bore 31 with internal screw threads for threading on the shaft section 56 of the bolt 50.

Sleeve 70 is a very important feature of the present invention. Referring back to FIGS. 2 through 5, on one hand, sleeve 70 is threadedly engaged with bolt 50. On the other hand, sleeve 70 is prevented from rotation by the sidewalls 21 and 23 of the U-shaped slot 20. Its cylindrical section 74 engages with the proximal end 30 of a respective limb. When the bolt 50 is turned, sleeve 70 will effectively be driven to move up or down along the bolt 50, thereby tightening or loosening the limb. By using the sleeve 70, the bolt 50 is not directly engaged with the limb. The vibration from the limb will transmit to the sleeve 70. However, since sleeve 70 is prevented from rotating, there can be no rotational force exerted from the sleeve 70 to the bolt 50. Therefore, the vibration from the limb cannot cause the bolt 50 to become loosened.

The plug 80 has a cylindrical section 82 and a widened outer flange section 84. The cylindrical section 82 is placed through the bottom opening 27 of the U-shaped slot 20 and has a central through bore 81 for receiving the shaft section 56 of the bolt 50. The flange section 84 has a bottom surface with secondary index scales 83 and a circular recess 85 connected to the through bore 81 for seating the end nut 90, such that the bottom surface of the end nut 90 is flush with the bottom surface of the flange section 84 of the plug 80. The flange section 84 further has a small transverse screw hole 88 connected to the recess 85.

The plug 80 is fastened to the bottom 25 of the U-shaped slot 20 by two small Allen screws 87 which threads through two opposite screw holes 86 in the flange section 84 of the plug 80. This prevents the plug from rotating or shifting in position.

The end nut 90 has a longitudinal screw hole 92 and is threaded on the end portion 58 of the shaft section 56 of the bolt 50. The end nut 90 also has a small transverse screw hole 94. A small Allen screw 96 is threaded through screw hole 94 and into the small transverse screw hole 59 in the end portion 58 of the shaft section 56 of the bolt 50, to prevent the end nut 90 from rotating on the end portion 58 of the shaft section 56 of the bolt 50. The end nut 90 further has a bottom surface with a secondary index mark 95 which again can be an arrow or a line (see FIG. 3). A small washer 98 may be placed with the recess 85 underneath the end nut 90.

A small Allen screw 89 is threaded through the small transverse screw hole 88 and engaged to the end nut 90 for locking the end nut 90. Since the end nut 90 is fastened to the bolt 50, locking the end nut 90 effectively locks the bolt 50, so that the bolt 50 can no longer rotate. The small Allen screw 89 can be loosened during the adjustment of the poundage and tiller of the bow by turning the bolt 50, and tightened when the adjustment is finished.

Once the adjustment is completed, the desired position of the bolt 50 is recorded by both the primary index scale 63 and the secondary index scales 83, as indicated by the primary index mark 55 and secondary index mark 95 respectively. This is another important feature of the present invention which saves the archer from repeated and laborious time consuming processes of readjusting the poundage and tiller of the bow after each shooting.

Defined in detail, the present invention is a limb bolt assembly for a recurve bow, the recurve bow having an upper limb, a lower limb, and a center riser with an upper end and a lower end each having a U-shaped slot for receiving a proximal end of a respective one of the upper and lower limbs, where the U-shaped slot is formed by two opposite sidewalls and a bottom which has an opening, the limb bolt assembly comprising: (a) a bolt having a generally cylindrical shaped head section, a circular disc shaped flange section, and a longitudinally elongated shaft section with outer screw threads, the head section having at least two opposite flattened surfaces for adopting a driving tool, the flange section having a circular upper surface with a primary index mark, and the shaft section having an end portion with a reduced diameter and a transverse screw hole; (b) a plate having a raised section and a circular disc shaped base section, the raised section having a top surface with primary index scales and a circular recess for seating the flange section of the bolt, such that the upper surface of the flange section of the bolt is flush with the top surface of the raised section, the base section bridging over on top of the two sidewalls of the U-shaped slot and having a center hole connected with the recess of the raised section for allowing the shaft section of the bolt to go through; (c) means for securing the base section of the plate on top of the U-shaped slot and preventing the plate from rotation; (d) a sleeve having a central through bore with internal screw threads for threading on the shaft section of the bolt, the sleeve further having an enlarged flange section and a cylindrical section, the flange section having a generally circular shaped circumferential rim with two straight portions respectively engaged with the two sidewalls of the U-shaped slot for preventing the sleeve from rotation, the cylindrical section engaging with the proximal end of the respective one of the upper and lower limbs; (e) an end nut threaded on the end portion of the shaft section of the bolt and having a transverse screw hole, the end nut further having a bottom surface with a secondary index mark; (f) means for fastening the end nut to the end portion of the shaft section of the bolt to prevent the end nut from rotating thereon; (g) a plug having a cylindrical section and a widened outer flange section, the cylindrical section placed through the bottom opening of the U-shaped slot and having a central through bore for receiving the end portion of the shaft section of the bolt, the flange section having a bottom surface with secondary index scales and a circular recess connected to the through bore for seating the end nut, such that the bottom surface of the end nut is flush with the bottom surface of the flange section, the flange section further having a small transverse screw hole connected to the recess; (h) means for fastening the plug to the bottom of the U-shaped slot; and (i) means for locking the end nut with the plug to prevent the bolt from rotation after adjustment; (j) whereby when the proximal end of the respective one of upper and lower limbs is received in the U-shaped slot and fastened between the sleeve and the bottom of the U-shaped slot, the sleeve can be driven along the shaft section of the bolt by rotating the bolt to adjust the poundage and tiller of the recurve bow, where the desired adjustment can be recorded by both the primary and the secondary index scales, and the bolt can be locked to prevent it from becoming loosened.

Defined broadly, the present invention is a limb bolt assembly for a recurve bow, the recurve bow having an upper limb, a lower limb, and a center riser with an upper end and a lower end each having a U-shaped slot for receiving a proximal end of a respective one of the upper and lower limbs, where the U-shaped slot has a bottom opening, the limb bolt assembly comprising: (a) a bolt having head section, a circular flange section, and a longitudinally elongated shaft section with outer screw threads, the flange section having an upper surface with an index mark, and the shaft section having a bottom end; (b) a plate having a raised section and a base section, the raised section having a top surface with index scales and a recess for seating the flange section of the bolt, the base section bridging over the U-shaped slot and having a center hole connected with the recess of the raised section for allowing the shaft section of the bolt to go through; (c) means for securing the base section of the plate on top of the U-shaped slot and preventing the plate from rotation; (d) sleeve having a central through bore with internal screw threads for threading on the shaft section of the bolt, the sleeve further having an enlarged flange section and a cylindrical section, the flange section engaged with inside of the U-shaped slot for preventing the sleeve from rotation, the cylindrical section engaging with the proximal end of the respective one of the upper and lower limbs; (e) an end nut threaded on the end of the shaft section of the bolt; (f) means for fastening the end nut to the end portion of the shaft section of the bolt to prevent the end nut from rotating thereon; (g) a plug mounted at the bottom opening of the U-shaped slot and having a central through bore for receiving the bottom end of the shaft section of the bolt, the plug further having a flange section having a recess connected to the through bore for seating the end nut; (h) means for fastening the plug to the bottom of the U-shaped slot; and (i) means for locking the end nut with the plug to prevent the bolt from rotation after adjustment; (j) whereby when the proximal end of the respective one of upper and lower limbs is received in the U-shaped slot and fastened between the sleeve and the bottom of the U-shaped slot, the sleeve can be driven along the shaft section of the bolt by rotating the bolt to adjust the poundage and tiller of the recurve bow, where the desired adjustment can be recorded by the index scales, and the bolt can be locked to prevent it from becoming loosened.

Defined more broadly, the present invention is a limb bolt assembly for a recurve bow, the recurve bow having an upper limb, a lower limb, and a center riser with an upper end and a lower end each having a slot for receiving a proximal end of a respective one of the upper and lower limbs, the limb bolt assembly comprising: (a) an elongated threaded bolt mounted across the slot; (b) means for indexing a rotational position of the bolt; (c) a sleeve located inside the slot and threadedly engageable with the elongated bolt, and further engaging with the proximal end of the respective one of the upper and lower limbs; (d) means for preventing the sleeve from rotating inside the slot; and (e) means for locking the bolt to prevent it from rotating after adjustment; (f) whereby when the proximal end of the respective one of upper and lower limbs is received in the slot and fastened therein, the sleeve can be driven along the bolt by rotating the bolt to adjust the poundage and tiller of the recurve bow, where the desired adjustment can be indexed by the index means, and the bolt can be locked to prevent it from becoming loosened.

Of course the present invention is not intended to be restricted to any particular form or arrangement, or any specific embodiment disclosed herein, or any specific use, since the same may be modified in various particulars or relations without departing from the spirit or scope of the claimed invention hereinabove shown and described of which the apparatus shown is intended only for illustration and for disclosure of an operative embodiment and not to show all of the various forms or modification in which the present invention might be embodied or operated.

The present invention has been described in considerable detail in order to comply with the patent laws by providing full public disclosure of at least one of its forms. However, such detailed description is not intended in any way to limit the broad features or principles of the present invention, or the scope of patent monopoly to be granted.

What is claimed is:

1. A limb bolt assembly for a recurve bow, the recurve bow having an upper limb, a lower limb, and a center riser with an upper end and a lower end each having a U-shaped slot for receiving a proximal end of a respective one of the upper and lower limbs, where the U-shaped slot is formed by two opposite sidewalls and a bottom which has an opening, the limb bolt assembly comprising:

a. a bolt having a generally cylindrical shaped head section, a circular disc shaped flange section, and a longitudinally elongated shaft section with outer screw threads, the head section having at least two opposite flattened surfaces for adopting a driving tool, the flange section having a circular upper surface with a primary index mark, and the shaft section having an end portion with a reduced diameter and a transverse screw hole;

b. a plate having a raised section and a circular disc shaped base section, the raised section having a top surface with primary index scales and a circular recess for seating said flange section of said bolt, such that said upper surface of said flange section of said bolt is flush with the top surface of the raised section, the base section bridging over on top of said two sidewalls of said U-shaped slot and having a center hole connected with said recess of said raised section for allowing said shaft section of said bolt to go through;

c. means for securing said base section of said plate on top of said U-shaped slot and preventing said plate from rotation;

d. a sleeve having a central through bore with internal screw threads for threading on said shaft section of said bolt, the sleeve further having an enlarged flange section and a cylindrical section, the flange section having a generally circular shaped circumferential rim with two straight portions respectively engaged with said two sidewalls of said U-shaped slot for preventing said sleeve from rotation, the cylindrical section engaging with said proximal end of said respective one of said upper and lower limbs; an end nut threaded on said end portion of said shaft section of said bolt and having a transverse screw hole, the end nut further having a bottom surface with a secondary index mark;

f. means for fastening said end nut to said end portion of said shaft section of said bolt to prevent said end nut from rotating thereon;

g. a plug having a cylindrical section and a widened outer flange section, the cylindrical section placed through said bottom opening of said U-shaped slot and having a central through bore for receiving said end portion of said shaft section of said bolt, the flange section having a bottom surface with secondary index scales and a circular recess connected to the through bore for seating said end nut, such that said bottom surface of said end nut is flush with the bottom surface of the flange section, the flange section further having a small transverse screw hole connected to said recess;

h. means for fastening said plug to said bottom of said U-shaped slot; and i. means for locking said end nut with said plug to prevent said bolt from rotation after adjustment;

j. whereby when said proximal end of said respective one of upper and lower limbs is received in said U-shaped slot and fastened between said sleeve and said bottom of said U-shaped slot, said sleeve can be driven along said shaft section of said bolt by rotating said bolt to adjust the poundage and tiller of said recurve bow, where the desired adjustment can be recorded by both said primary and said secondary index scales, and said bolt can be locked to prevent it from becoming loosened.

2. The invention as defined in claim 1 wherein said means for securing said base section of said plate on top of said U-shaped slot and preventing said plate from rotation includes a small cap screw.

3. The invention as defined in claim 1 wherein said means for fastening said end nut to said end portion of said shaft section of said bolt to prevent said end nut from rotating thereon includes a small Allen screw threaded through said small transverse hole in said end nut and into said small transverse hole in said end portion of said shaft section of said bolt.

4. The invention as defined in claim 1 wherein said means for fastening said plug to said bottom of said U-shaped slot includes two small Allen screws respectively threaded through two small screw holes in said flange section of said plug and into two small screw holes in said bottom of said U-shaped slot.

5. The invention as defined in claim 1 wherein said means for locking said end nut with said plug to prevent said bolt from rotation after adjustment includes a small Allen screw threaded through said small transverse screw hole in said flange section of said plug and engaged with said end nut seated in said recess of said flange section of said plug.

6. A limb bolt assembly for a recurve bow, the recurve bow having an upper limb, a lower limb, and a center riser with an upper end and a lower end each having a U-shaped slot for receiving a proximal end of a respective one of the upper and lower limbs, where the U-shaped slot has a bottom opening, the limb bolt assembly comprising:

a. a bolt having a head section, a circular flange section, and a longitudinally elongated shaft section with outer screw threads, the flange section having an upper surface with an index mark, and the shaft section having a bottom end;

b. a plate having a raised section and a base section, the raised section having a top surface with index scales and a recess for seating said flange section of said bolt, the base section bridging over said U-shaped slot and having a center hole connected with said recess of said raised section for allowing said shaft section of said bolt to go through;

c. means for securing said base section of said plate on top of said U-shaped slot and preventing said plate from rotation;

d. a sleeve having a central through bore with internal screw threads for threading on said shaft section of said bolt, the sleeve further having an enlarged flange section and a cylindrical section, the flange section engaged with the inside of said U-shaped slot for preventing said sleeve from rotation, the cylindrical section engaging with said proximal end of said respective one of said upper and lower limbs;

e. an end nut threaded on said end of said shaft section of said bolt;

f. means for fastening said end nut to said end portion of said shaft section of said bolt to prevent said end nut from rotating thereon;

g. a plug mounted at said bottom opening of said U-shaped slot and having a central through bore for receiving said bottom end of said shaft section of said bolt, the plug further having a flange section having a recess connected to the through bore for seating said end nut;

h. means for fastening said plug to said bottom of said U-shaped slot; and i. means for locking said end nut with said plug to prevent said bolt from rotation after adjustment;

j. whereby when said proximal end of said respective one of upper and lower limbs is received in said U-shaped slot and fastened between said sleeve and said bottom of said U-shaped slot, said sleeve can be driven along said shaft section of said bolt by rotating said bolt to adjust the poundage and tiller of said recurve bow, where the desired adjustment can be recorded by said index scales, and said bolt can be locked to prevent it from becoming loosened.

7. The invention as defined in claim 6 wherein said head section has at least two opposite flattened surfaces for adopting a driving tool.

8. The invention as defined in claim 6 wherein said means for securing said base section of said plate on top of said U-shaped slot and preventing said plate from rotation includes a small cap screw.

9. The invention as defined in claim 6 wherein said end nut has a bottom surface with a secondary index mark, and the flange section of said plug has a bottom surface with secondary index scales, so that the desired adjustment can also be recorded by the secondary index scales.

10. The invention as defined in claim 6 wherein said means for fastening said end nut to said bottom end of said shaft section of said bolt to prevent said end nut from rotating thereon includes a small Allen screw threaded through a small transverse hole in said end nut and into a small transverse hole in said bottom end of said shaft section of said bolt.

11. The invention as defined in claim 6 wherein said means for fastening said plug to said bottom of said U-shaped slot includes at least one small Allen screw threaded through at least one small screw hole in said flange section of said plug and into at least one small screw hole in said center riser located adjacent to said U-shaped slot.

12. The invention as defined in claim 6 wherein said means for locking said end nut with said plug to prevent said bolt from rotation after adjustment includes a small Allen screw threaded through a small transverse screw hole in said flange section of said plug and engaged with said end nut seated in said recess of said flange section of said plug.

13. A limb bolt assembly for a recurve bow, the recurve bow having an upper limb, a lower limb, and a center riser with an upper end and a lower end each having a slot for receiving a proximal end of a respective one of the upper and lower limbs, the limb bolt assembly comprising:

a. an elongated threaded bolt mounted across said slot;

b. means for indexing a rotational position of said bolt;

c. a sleeve located inside said slot and threadedly engageable with said elongated bolt, and further engaging with said proximal end of said respective one of said upper and lower limbs;

d. means for preventing said sleeve from rotating inside said slot; and e. means for locking said bolt to prevent it from rotating after adjustment;

f. whereby when said proximal end of said respective one of upper and lower limbs is received in said slot and fastened therein, said sleeve can be driven along said bolt by rotating said bolt to adjust the poundage and tiller of said recurve bow, where the desired adjustment can be indexed by said index means, and said bolt can be locked to prevent it from becoming loosened.

14. The invention as defined in claim 13 wherein said elongated bolt has a head section with at least two opposite flattened surfaces for adopting a driving tool.

15. The invention as defined in claim 13 wherein said index means includes at least one index mark on said bolt, and a plate mounted to said slot adjacent to said index mark on said bolt and having index scales.

16. The invention as defined in claim 13 wherein said means for preventing said sleeve from rotating inside said slot includes a flange on said sleeve which is engaged with inside of said slot for preventing said sleeve from rotation.

17. The invention as defined in claim 13 further comprising a plug mounted at a bottom opening of said U-shaped slot for receiving a bottom end of said elongated bolt.

18. The invention as defined in claim 17 further comprising an end nut attached to said elongated bolt and seated in a bottom recess of said plug.

19. The invention as defined in claim 18 wherein said end nut has a bottom surface with at least one secondary index mark, and said plug has a bottom surface with secondary index scales, so that said rotational position of said bolt can also be indexed by the secondary index scales.

20. The invention as defined in claim 18 wherein said means for locking said bolt to prevent it from rotating after adjustment includes a small Allen screw threaded through a small transverse screw hole in said plug and engaged with said end nut seated in said recess of said plug.

* * * * *